US006360496B1

(12) United States Patent
Raccuglia

(10) Patent No.: US 6,360,496 B1
(45) Date of Patent: Mar. 26, 2002

(54) CIRCULAR BUILDING STRUCTURE

(76) Inventor: Giovanni Raccuglia, 41 Mulberry Point Rd., Guilford, CT (US) 06437

( * ) Notice: Subject to any disclaimer, the term of this patent is extended or adjusted under 35 U.S.C. 154(b) by 0 days.

(21) Appl. No.: 09/607,497

(22) Filed: Jun. 30, 2000

(51) Int. Cl.[7] ..... E04H 1/00; E02D 27/52; E02D 29/02

(52) U.S. Cl. ..... 52/169.1; 52/169.11; 52/200; 52/245; 52/63; 52/82; 52/222; 52/236.2

(58) Field of Search ..... 52/245, 236.2, 52/222, 169.1, 169.11, 82, 63, 294, 309.12, 169.13

(56) References Cited

U.S. PATENT DOCUMENTS

| | | | | | |
|---|---|---|---|---|---|
| 481,347 | A | * | 8/1892 | Cunningham | 52/82 |
| 589,563 | A | * | 7/1897 | Jensen | 52/63 |
| 1,157,158 | A | * | 10/1915 | Harry | 52/245 |
| 1,473,845 | A | * | 11/1923 | Gardon | 52/63 |
| 2,282,756 | A | * | 5/1942 | Curran | 52/82 X |
| 2,343,764 | A | | 3/1944 | Fuller | |
| 2,463,834 | A | * | 3/1949 | Von Breton | 52/245 |
| 2,499,478 | A | | 3/1950 | Feser | |
| 2,559,868 | A | | 7/1951 | Gay | |
| 2,753,818 | A | * | 7/1956 | Green | 52/82 X |
| 3,295,265 | A | * | 1/1967 | Hida | |
| 3,336,704 | A | * | 8/1967 | Clay | 52/222 X |
| 3,375,831 | A | | 4/1968 | Serbus | |
| 3,707,812 | A | | 1/1973 | Roessl | |
| 4,015,381 | A | | 4/1977 | Schmidt | |
| 4,275,534 | A | | 6/1981 | Porter | |
| 4,332,116 | A | | 6/1982 | Buchanan | |
| 4,468,902 | A | | 9/1984 | Wilson | |
| 5,444,943 | A | * | 8/1995 | Schelfhorst | 52/222 X |
| 5,540,020 | A | * | 7/1996 | Santini | 52/309.12 X |
| 5,615,525 | A | * | 4/1997 | Kenworthy | 52/169.11 X |
| 5,860,258 | A | * | 1/1999 | Faith et al. | 52/82 X |
| 5,934,036 | A | * | 8/1999 | Gallagher | 52/294 X |

* cited by examiner

*Primary Examiner*—Robert Canfield
(74) *Attorney, Agent, or Firm*—Bachman & LaPointe, P.C.

(57) ABSTRACT

The present invention relates to a circular building structure which comprises a plurality of columnar structures, each of which extends from a point below ground level to a desired height above ground level and wall structures positioned between the columnar structures and forming a substantially circular exterior wall with the columnar structures. The wall structures and the columnar structures enclose a substantially circular inner space. The building structure further includes a central hub positioned above the inner space. A plurality of trusses for supporting a roof are provided. Each of the trusses is joined to a respective one of the columnar structures and to the central hub. The inner space is divided into a perimetric space and an interior space by an interior wall which is concentric with the exterior wall. The perimetric space, in a preferred construction, is divided by walls into at least one passageway and a number of rooms. The interior space, in a preferred construction, is left as an undivided space which serves as a common area for eating, cooking, and other activities.

51 Claims, 7 Drawing Sheets

CIRCULAR BUILDING STRUCTURE

BACKGROUND OF THE INVENTION

The present invention relates to a circular building structure having particular utility as a dwelling.

Circular building structures have been proposed for many years. Examples of such structures include U.S. Pat. Nos. 4,015,381 to Schmidt; 2,343,764 to Fuller; 2,499,478 to Feser; 3,707,812 to Roessl; 3,375,831 to Serbus; and 4,332,116 to Buchanan.

The Schmidt patent illustrates a circular building structure having a slab foundation and an upstanding perimeter wall structure enclosing a generally circular plan area. The perimeter wall is supported from the foundation. A central upstanding columnar roof support is provided and supported at its lower end by the foundation centrally of the area enclosed by the perimeter wall structure. The column is tubular. A support frame encircles and is supported from the upper end of the column at a level spaced above the upper portions of the perimeter wall structure. The support frame is spaced outwardly of the column. Downwardly and outwardly inclined roof rafter members are spaced about the column in generally radial planes with their upper innermost end portions anchored relative to corresponding upper marginal portions of the perimeter wall structure. A roof structure is secured over the rafter members and includes a central void area defined by upper marginal portions of the roof structure spaced outwardly from and extending about the upper end portion of the column. A cap structure is supported from the upper marginal portions of the roof structure and the upper end portion of the column forming a weather closure over the upper portion of the roof structure. The foundation supports a heater including a flue opening into the interior of the column. The roof structure includes inner lower panel structures underlying the rafters as well as insulation material disposed between adjacent rafters and overlying the inner panel structures but spaced from the upper marginal portions of the rafters, the spacing between adjacent rafters above the insulation material defining air circulation passages. The cap structure includes a ventilation outlet for venting the air circulation passages. A seal structure is provided to form an air seal against airflow between the column outer surface and the adjacent inner portions of the roof structure.

U.S. Pat. No. 4,275,534 to Porter illustrates another type of building structure, namely a hexagonal building structure, which has a steel frame including a connection which joins tension ring members, columns, and roof trusses together with threaded fasteners. The upper ends of the rafters are joined by a compression ring. The bottom of each column is secured to a base by means of an adjustable base plate. Rafters spanning between the tension ring and compression ring are located between adjacent trusses. The frame is adapted to receive prefabricated sandwich type panels for both roof and walls.

Still other types of building structures are shown in U.S. Pat. No. 2,559,868 to Gay and U.S. Pat. No. 4,468,902 to Wilson. The Gay patent illustrates a cellarless house which is constructed so that its exposed walls are adapted to provide envelope forming passages through which air can be circulated with interior temperature controlling effect. The Wilson patent relates to multi-walled structures embodying two or more spaced members arranged to provide an enclosed space therebetween for controlling the transmission of energy through the members for the purpose of capturing, storing and releasing energy.

Despite the existence of these structures, there is still a need for aesthetically pleasing building structures, having particular utility as a dwelling, which promote the togetherness of its occupants.

SUMMARY OF THE INVENTION

Accordingly, it is an object of the present invention to provide an aesthetically pleasing building structure.

It is a further object of the present invention to provide a building structure as above which may be used for a variety of purposes.

It is yet a further object of the present invention to provide a building structure as above which has particular utility as a dwelling.

It is yet a further object of the present invention to provide a building structure which is easy to construct and easy to maintain.

The foregoing objects are attained by the circular building structure of the present invention.

In accordance with the present invention, a circular building structure comprises a plurality of columnar structures, each of which preferably extends from a point below ground level to a desired height above ground level, and wall structures positioned between the columnar structures and forming a substantially circular exterior or outer wall with the columnar structures which encloses an inner space. A central hub is positioned above the inner space. A plurality of trusses are provided to support a roof. Each of the trusses is joined to one of the columnar structures and to the central hub. The inner space is preferably divided into a perimetric space and an interior space. The perimetric space, if desired, may be divided by walls into a passageway, an entranceway hall, and a number of rooms. The interior space is. preferably left as a common area for eating, cooking, and other communal activities. If desired, semi-private areas may be created in the common area through devices such as planters.

Other details of the building structure of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
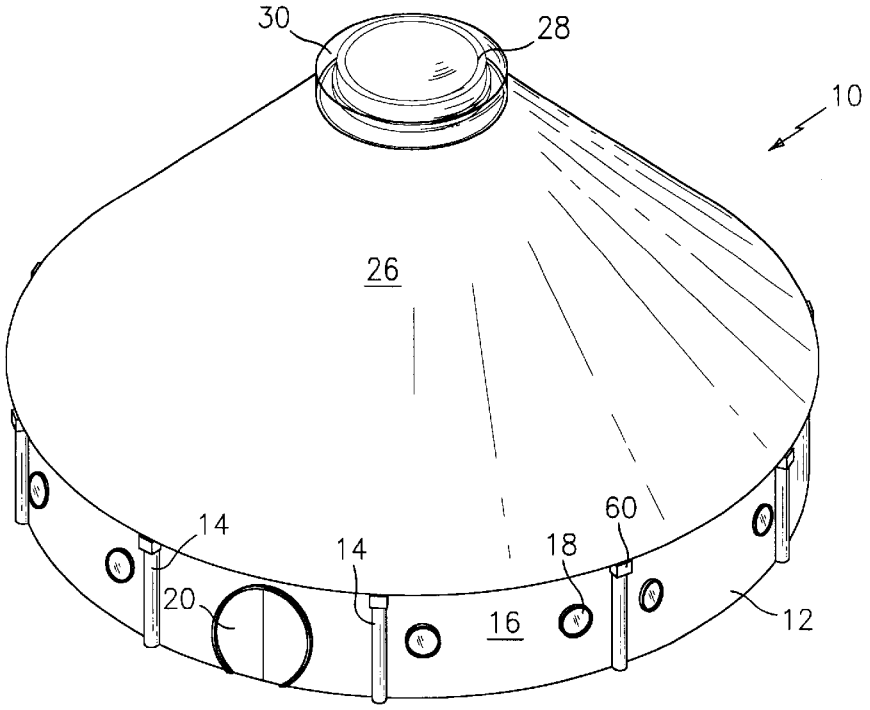
FIG. 1 is a perspective view of a circular building structure in accordance with the present invention.
Figure 2:
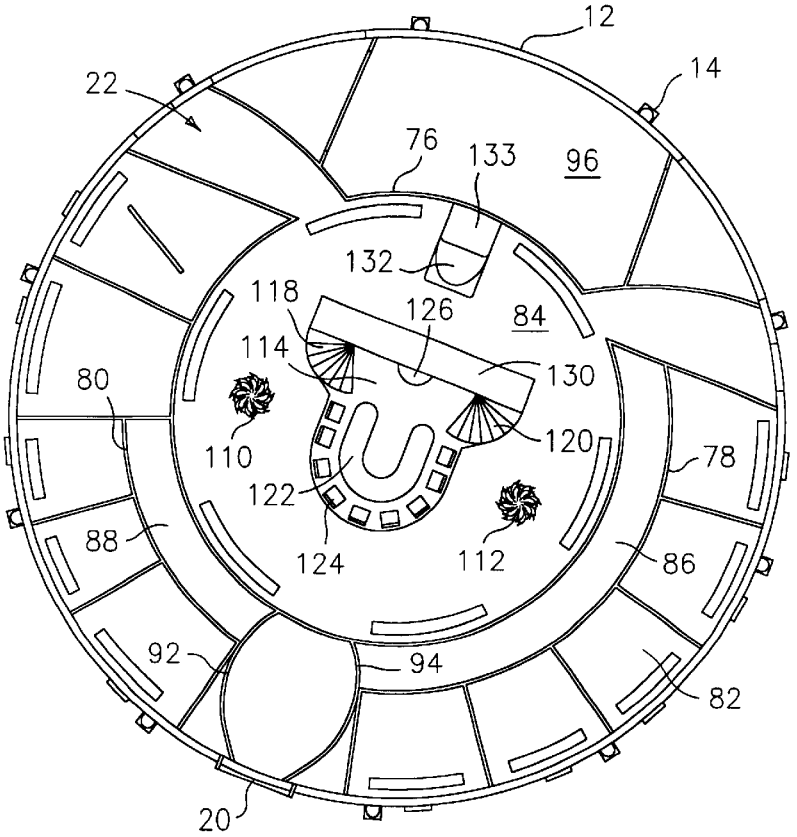
FIG. 2 is a top view of the circular building structure of FIG. 1 with the roof removed.

Referring now to the drawings, FIG. 1 illustrates a circular building structure 10 in accordance with the present invention. While the building structure will be described in the context of a dwelling, it should be recognized that it may be used as an office building, a storage building, and the like. As shown in FIG. 1, the building structure 10 has a substantially circular exterior or outer wall 12 formed by a plurality of spaced apart columnar structures 14 and intermediate wall sections 16. The wall sections 16 may include windows 18 and one or more exterior doors 20. As shown in FIG. 2, the exterior wall 12 encloses a substantially circular inner space 22.

Figure 7:
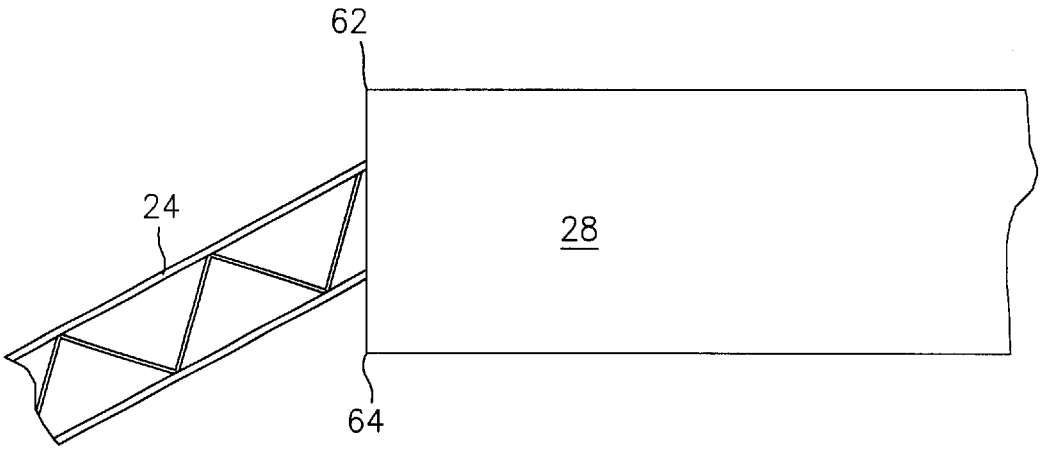
FIG. 7 is a side view of a portion of the structure for supporting the roof.
Figure 8:
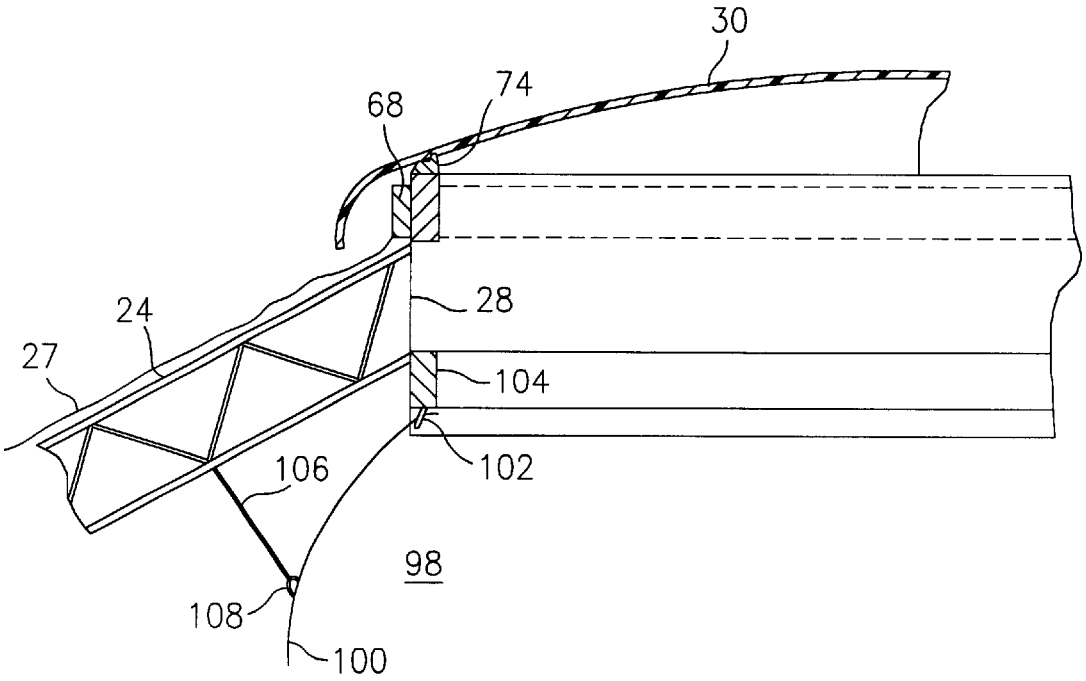
FIG. 8 is a sectional view of the central hub used to support a roof canopy, an inner canopy, and a skylight.

As will be described in more detail hereinafter, the columnar structures 14 support the lower end of a plurality of trusses 24 for supporting a roof 26. The trusses 24 are supported at their upper end by a central hub 28. This is shown in FIGS. 7 and 8. A skylight 30 is placed over the central hub 28 to allow sunlight to penetrate into the inner space 22.

The roof 26 may be formed from any suitable lightweight material known in the art. Preferably, the roof 26 is formed as a roof canopy from a water repellant material such as canvas, MYLAR and the like. Other details of the roof 26 will be discussed hereinafter.

Figure 3:
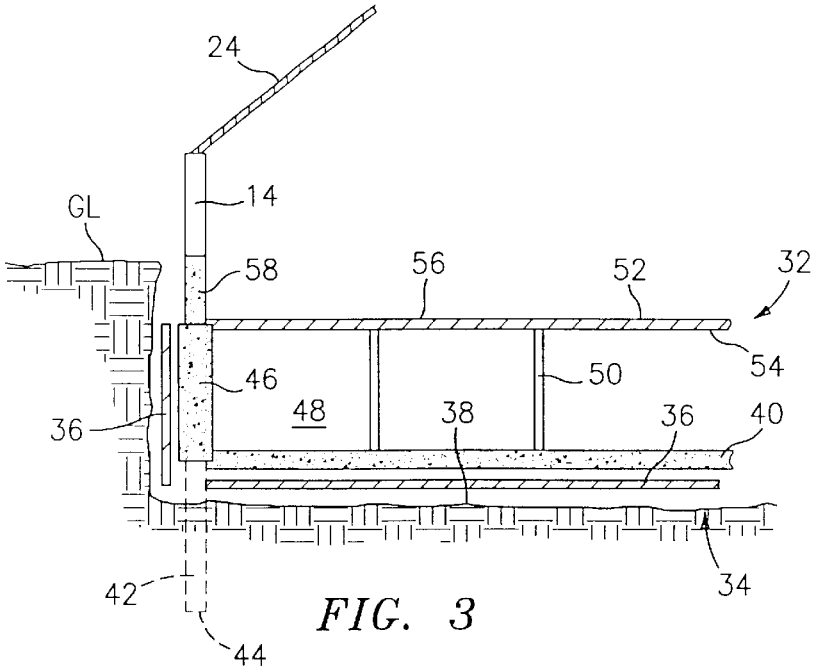
FIG. 3 is a sectional view of the foundation and crawl space construction for the building structure of FIG. 1.

The circular building structure 10 is formed on a foundation. Referring now to FIG. 3, a portion of the foundation 32 for the building structure 10 is shown. The foundation 32 is formed on an excavated cylindrical space 34, which space extends to a point which is preferably about 8 feet, 2 inches below ground level GL. A heat insulating material 36, such as a plurality of STYROFOAM sheets, is placed over the bottom surface 38 of the excavated space 34. A circular concrete ground slab 40 is then poured over the heat insulating material 36. A plurality of spaced apart columnar structures 14 are formed about the excavated space 34. Preferably, the columnar structures 14 are equally spaced about the perimeter of the excavated space 34. Each of the columnar structures 14 is preferably supported by a concrete footing 42. The footing 42 may be a continuous footing which extends about the perimeter of the excavated space 34 or an isolated footing for each columnar structure.

The columnar structures 14 may be constructed in any suitable manner known in the art. The construction of the columnar structures 14 must be such that each columnar structure can serve as a load bearing element. In a preferred construction, each columnar structure 14 projects about 13 feet, 2 inches above the lowest level 44 and has a diameter of about 1 foot. While these dimensions are preferred, the columnar structures may have any desired height and any desired diameter.

After the columnar structures 14 have been formed, a retaining wall 46 is formed between the columnar structures 14. The retaining wall 46 serves to retain the below ground level grade in place and form the outer periphery of a crawl space 48. While the retaining wall 46 preferably has a height of about 5 feet, it can have any desired height. The retaining wall 46 may be formed in any suitable manner from any suitable material such as concrete. Preferably, the retaining wall 46 is poured against additional heat insulating material 36.

Figure 4:
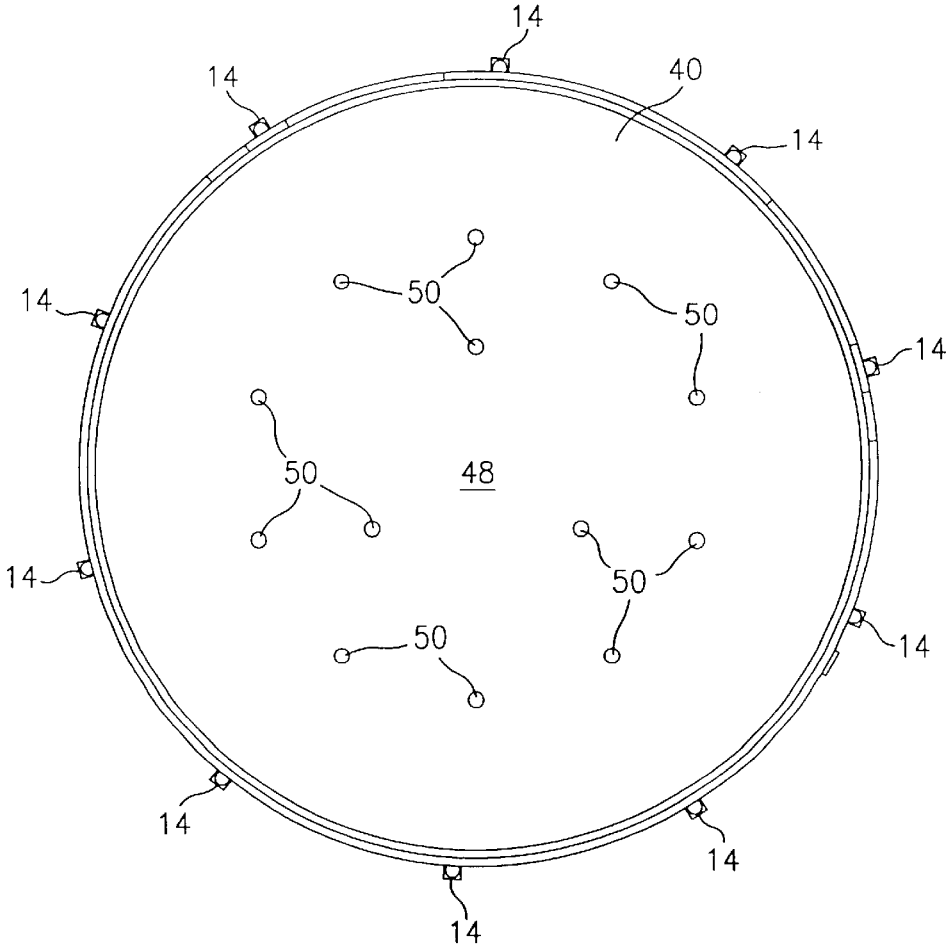
FIG. 4 is a top view of the crawl space beneath the building structure of FIG. 1.

As shown in FIGS. 3 and 4, a number of steel columns 50 are embedded within the concrete slab 40. The steel columns 50 may be distributed within the crawl space 48 in any desired pattern and may have any desired height. Preferably, they have a height of about 5 feet. The primary purpose of the steel columns 50 is to support a floor 52 for the building structure. The floor 52 may be a planar floor or it may be a floor which has different levels. For example, one portion of the floor may be higher than the other so that a pit area can be formed.

The upper surface of the retaining wall 46 and the upper end of the columns 50 support the floor 52 either directly or via a plurality of I beams (not shown) stretched over the columns 50. The ground slab 40, the retaining wall 46 and the lower surface 54 of the floor 52 define the crawl space 48.

The upper surface 56 of the floor 52 is preferably situated below ground level, preferably by about 3 feet, for heat conservation purposes. When the floor 52 is below ground level, a concrete retaining wall 58 may be built above the upper end of the crawl space retaining wall 46 to hold the soil in place. In a preferred construction, the concrete retaining wall 58 is thinner than the retaining wall 46 and comprises individual wall panels which extend from one columnar structure 14 to an adjacent columnar structure 14. The retaining wall panels 58 are preferably used to form the wall sections 16.

While it is preferred that the upper surface 56 of the floor 52 be located below ground level, it is also possible to form a building structure with the floor 52 at ground level. In such a construction, there is no need to form the retaining walls 58. Instead, wall sections 16 may be formed as desired. Also in such a construction, the crawl space 48 preferably has a depth discussed above.

Figure 5:
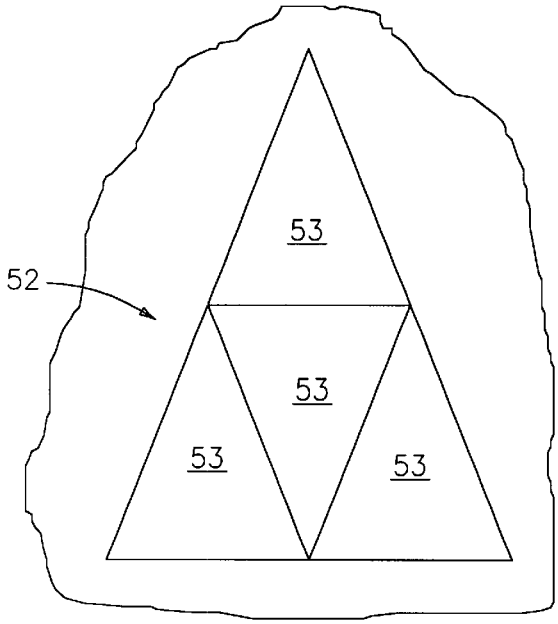
FIG. 5 is a perspective view of a portion of the floor.

The floor 52 may be formed in any desired fashion. As previously discussed, it may be planar or it may have different levels. As shown in FIG. 5, the floor 52 may be formed by juxtaposed elements 53 of geometric shape, such as squares, rectangles, triangles, and polygons, that are about 2 inches thick. The floor elements may be of any suitable material, such as marble, stone, prefabricated reinforced concrete sections, and steel sheets.

Figure 6:
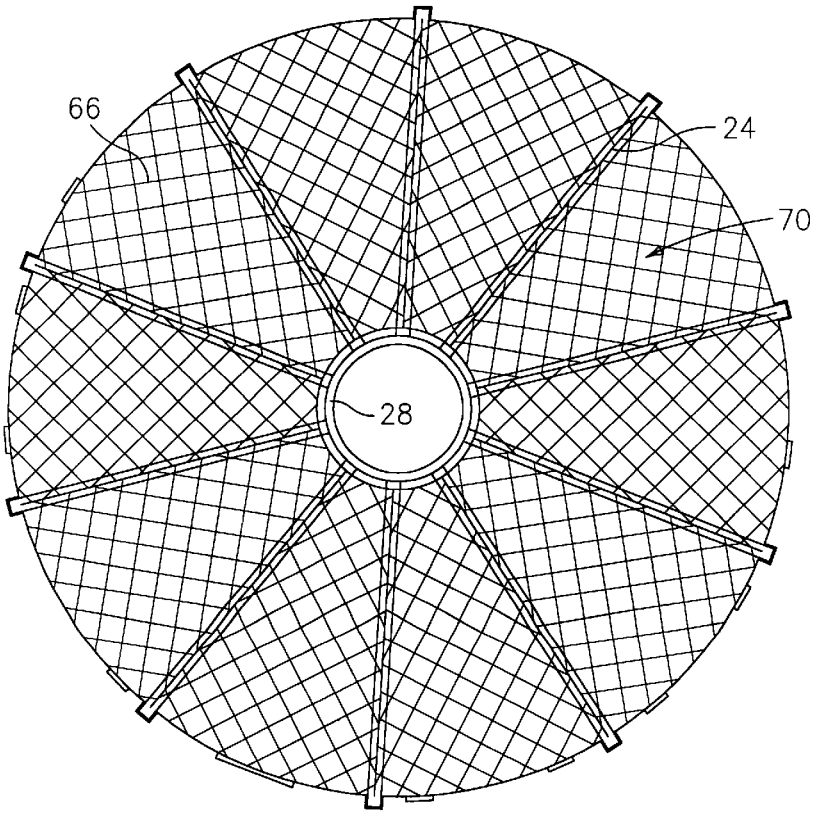
FIG. 6 is a perspective view of the circular building of FIG. 1 showing the support structure for the roof.

Referring now to FIG. 6, the support structure for the roof 26 is formed by a plurality of trusses 24. The trusses 24 are each anchored at one end to the top of one of the columnar structures 14 and at the other end to the central hub 28. Each truss 24 may be joined to the top of a respective columnar structure 14 using any suitable means and technique known in the art. Preferably, the lower end of the truss 24 sits within a box like structure 60 formed at the top of the columnar structure 14. The trusses may be formed from any suitable material known in the art and may have any desired construction. For example, they may be wood or metal beams of the type shown in FIG. 6.

The central hub 28 has a cylindrical configuration and may be formed from either steel or plastic. Preferably, the hub 28 has an external diameter of about 9 feet and a height of 3 feet. The hub 28 serves a number of purposes which will be discussed hereinafter.

The first function performed by the hub 28 is to anchor the upper end of the trusses 24. In this regard, the upper ends of the trusses 24 may be welded or otherwise fastened to an exterior surface of the hub 28. As shown in FIG. 7, the trusses 24 are joined to the hub 28 at a distance below the upper edge 62 of the hub 28 and at a distance above the lower edge 64 of the hub 28. In a preferred embodiment, the trusses 24 are joined to the hub at a first location about 4.5 inches below the upper edge 62 and at a second location about 4 inches above the lower edge 64.

As shown in FIG. 6, a mesh 66, such as a heavy steel mesh, is joined to the upper surface of the trusses 24, such as by welding or via appropriate connectors (not shown). The mesh 66 is preferably formed by trapezoidal sections which when disposed in succession form a continuum surface upon which a cover 27 forming the roof 26 is placed.

The roof cover 27, as previously discussed, is formed from a water repellant fabric such as MYLAR or canvas. Preferably, it is pre-shaped as a truncated cone. The upper end of the roof cover has a flat steel or plastic ring 68. The ring 68 is fabricated with sufficient clearance to fit against the upper part of the hub 28. The bearing of the ring 68 is the second function of the hub 28.

The use of the roof cover 27 offers a number of significant advantages. First, the cover 27 may be prefabricated in factories. Second, its use eliminates the use of lumber. Third, its installation requires minimal labor. In fact, the roof cover 27 may be changed with relative ease using a crane. Thus, owners of the building structure can change the roof cover at their whim to provide a roof cover with a business logo, a favorite team logo, different colors for different times of the year, different patterns, etc. Still further, the roof cover 27 can be reversible and have different colors and/or different patterns on its upper and lower surfaces. Fourth, the roof cover 27 is lighter and less expensive than a conventional roof, while fulfilling all the functional purposes of roofing.

Figure 9:
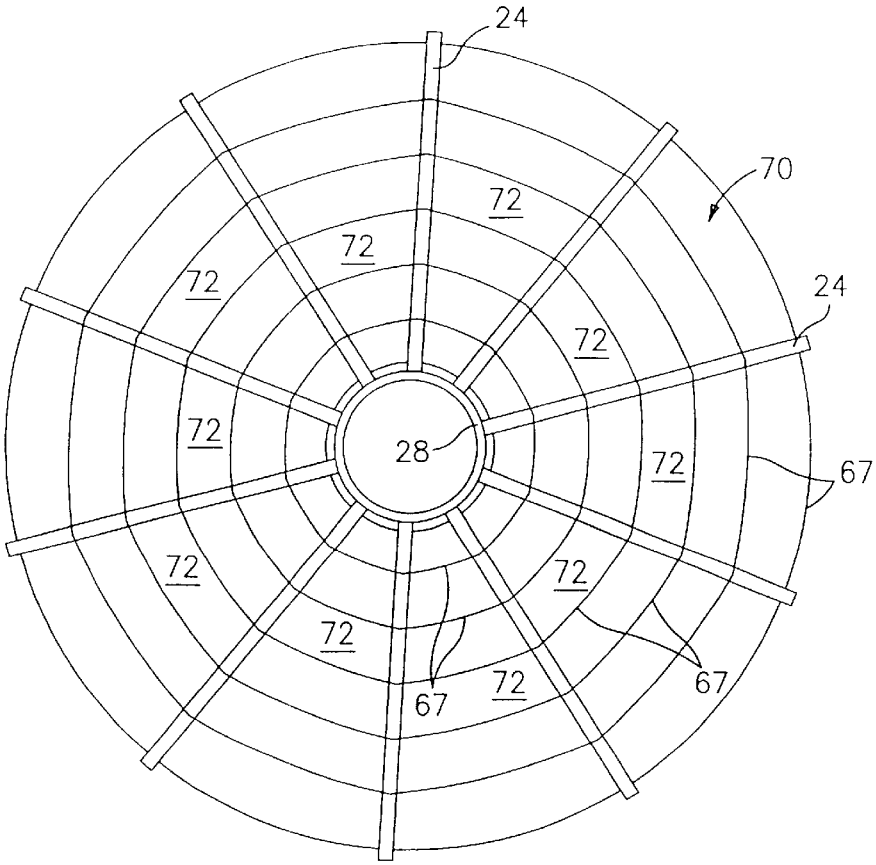
FIG. 9 is a bottom view of the roof support structure.

As shown in FIG. 9, the spaces 70 between the trusses 24, below the mesh 66, are filled with light-weight insulating material 72, such as STYROFOAM or foam rubber. The insulating material 72 is preferably prefabricated to fit the trapezoidal areas. The insulating material 72 may either be attached to the lower surface of the mesh 66 with simple devices such as a VELCRO arrangement or may be secured in place by cords 67 stretched between the trusses (see FIG. 9). They also may be secured in place by a frame work (not shown).

A third function of the hub 28 is to support a dish-shaped skylight 30. As shown in FIG. 8, the skylight 30 is held in place by a flat ring 74 attached under its lower surface and fabricated to fit in, and be secured to, the interior of the hub 28. Preferably, the ring 74 is about 4.5 inches high. When the skylight 30 is seated on the hub 28, it preferably covers the ring 68 and a portion of the roof cover 27. As previously discussed, the skylight 30 allows natural light to enter the inner space 22.

Figure 10:
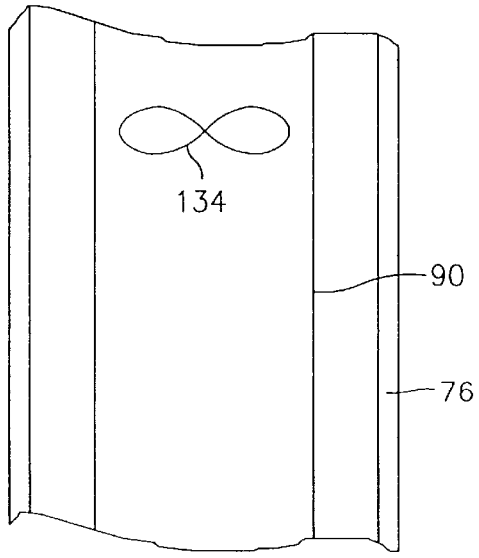
FIG. 10 is a sectional view of an interior wall.

Referring now to FIG. 2, the building structure 10 is erected with an interior wall 76 and arcuate wall sections 78 and 80. The interior wall 76 and the arcuate wall sections 78 and 80 are preferably concentric with the outer wall 12. The interior wall 76 divides the interior space 22 into a perimetric space 82 and a substantially circular internal space 84. The arcuate wall sections 78 and 80 form passageways 86 and 88 with the interior wall 76. As can be seen from the drawings, the interior wall 76 forms a complete right circular cylinder which is interrupted only by functional openings such as doorways. Since the interior wall 76 is non-load bearing, it can be constructed of any desired material. The material and construction of the interior wall 76 should allow the placement of plastic pipes 90 (see FIG. 10), imbedded vertically and parallel to each other. The pipes 90 are used for the convection of air from the crawl space 48 to other portions of the building structure 10.

As shown in FIG. 2, a number of walls may be fabricated between the outer wall sections 16 and the arcuate wall sections 78 and 80 to form a number of perimetric rooms and one or more entranceway halls. For example, two arcuate walls 92 and 94 may be used to form an entranceway hall for gaining access to the interior of the building structure 10 via a door 20. Each of the walls 92 and 94 preferably has an opening (not shown) to allow entry/exit to/from the passageways 86 and 88. Still further, the arcuate wall sections 78 and 80 may have a number of openings (not shown) which allow access to the rooms from the passageways 86 and 88. If desired, walls may be formed so that the perimetric space 82 includes a garage 96. When a garage is present in the perimetric space, an insulated wall (not shown) separates the area beneath the garage 96 from the remainder of the crawl space 48. This is done for the purpose of temperature conservation since the garage 96 will be exposed to the outside weather, and in order to make room for the placement of heating and cooling equipment. The perimetric rooms may be used as bedrooms, studies, dens, storage rooms, laundry rooms, etc.

One of the advantages to the building structure of the present invention is that the insulation positioned between the bottom and at the sides of the crawl space 48, as well as the underground positioning of the lower part of the building structure 10, favor heat conservation. The top level of the crawl space 48 is preferably made of a heat conductive or heat retainer material that functions as a heat exchanger. The crawl space 48 for all purposes is an air holding tank.

The substantially circular internal space 84 is preferably undivided to promote communal activities. The ceiling 98 above the internal space 84 is preferably formed by a cloth canopy 100 shaped as a dome or a truncated cone. FIG. 8 shows the inner canopy 100. The upper aim 102 of the canopy 100 may be attached to a flat ring 104 similar to that of the roof cover, but fabricated to fit within the interior of the hub 28. The ring 104 is preferably fastened to the hub 28 by removable pins. Thus, as seen from the foregoing description, the fourth function of the hub 28 is to receive the inner canopy ring 104 and hold the suspended inner canopy 100.

The inner canopy 100 may be made of a translucent material, such as nylon or a sail-like fabric. The lower margin or edge of the canopy 100 is supplied with a series of devices (not shown), such as clips, to allow fastening of the canopy boarder to the upper surface of the interior wall 76. If the canopy is left loose, fastened only at the upper and lower edges, gravity will define its shape. To obtain a dome-like effect, the upper surface of the canopy 100 may be provided with devices such as tensioning wires 106 to pull the canopy 100 to the desired form. The tensioning wires may be connected to small rings 108 sewed on the canopy 100 at appropriate intervals and to the lower surfaces of the trusses 24. If desired, the inner canopy can be sustained from the outside by a series of ribs (not shown).

Like the roof cover 27, the inner canopy 100 may be changed with reasonable effort and speed. Thus, owners of the building structure can have multiple inner canopies of different colors and designs which may be used at different times to create desired aesthetic effects. The diffuse light outside of the canopy may be used to achieve a pleasant and aesthetically pleasing environment and atmosphere.

Referring again to FIG. 2, the substantially circular internal space 84 defined by the interior wall 76 defines the area of major activity for the structure. The internal space 84 is an organic unit of undivided volume, partially interrupted by two planters 110 and 112. In a preferred construction of the building when it is to serve as a dwelling, a dining pit 114 is located at the center of the space 84. The dining pit 114 may be about 4.5 feet below the remainder of the floor 52. Access to the floor of the dining pit 114 is provided by two spiral staircases 118 and 120, situated laterally near one end of the dining pit 114. The dining pit 114 is preferably U-shaped, although other configurations may be used. As shown in FIG. 2, the dining pit 114 may contain a semi-circular dining table 122 surrounded by either chairs 124 or a continuous bench.

In a preferred construction of the internal space 84, a fireplace 126 is located at one end. A rectangular structure 130 is provided above the fireplace 126 and serves as a cover for part of the conduits (not shown) venting the fireplace 126. These conduits run under the floor 52 and within other structures to reach outside of the building structure 10. Also within the area 84 is the kitchen with a range 132 and a hood 133. The rectangular structure 130 may also serve as a kitchen work bench. The rectangular structure 130 may also contain an integrated refrigerator, other appliances and plumbing. The remainder of the area 84 is interrupted by the planters 110 and 112 so as to provide areas of semi-privacy such as a library, a breakfast area, a craft work area, or a play area. Since the internal space 84 is defined by a non-load bearing wall 76, it may be used as wished, free of the obligation of parallelogram arrangements.

A particular advantage to the building structure of the present invention is the superimposition of the living space on the crawl space 48. This facilitates the circulation of air between the two zones. The movement of hot or cold air is attained through the pipes 90, which pipes communicate with the crawl space 48 and heating/cooling equipment therein. Each of the pipes 90 contains an individual air moving device 134, such as a fan, preferably adjacent its lower end. The pipes 90 and the interior wall 76 may be provided with openings directed toward the inner or perimetric spaces 84 and 82 respectively. Large slots (not shown) placed at the periphery of the internal area 84 and in the individual rooms between the outer and internal walls serve as air returns and as supplementary devices allowing hot air to move upward by its natural tendency to rise. Since the floors in these areas could be formed from heat conductive material, marble, stone, or metal, the floors should function as a medium favoring equalization of temperature in the upper and lower zones. It should be recognized that the elimination of convolute conduits is another labor saving expedient of the present invention.

Figure 11:
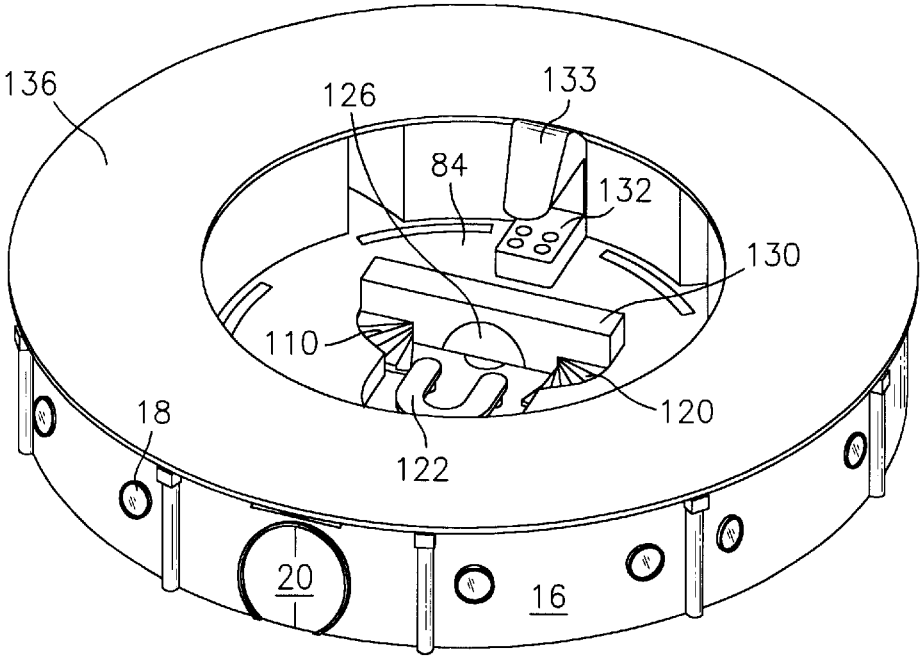
FIG. 11 is a top view of the circular building structure of FIG. 1 without the roof support structure and showing the ceiling over the perimetric space.

As shown in FIG. 11, the perimetric space 82 is preferably covered by a flat ceiling 136. The ceiling 136 may be formed using any suitable technique known in the art such as by using studs and drywall.

In the building structure 10, the interior wall 76 has no windows. As a result, natural light from the outside penetrates the internal space 84 only via the skylight 30. If desired, additional sections of the wall 76 may be removed to allow viewing of the outside. Lights (not shown) placed above the ceiling diffuses over the outer surface of the canopy 100 and illuminates the area 84. Sconces (not shown) placed along the inside wall 76 of the living space may be used to supply additional light.

Figure 12:
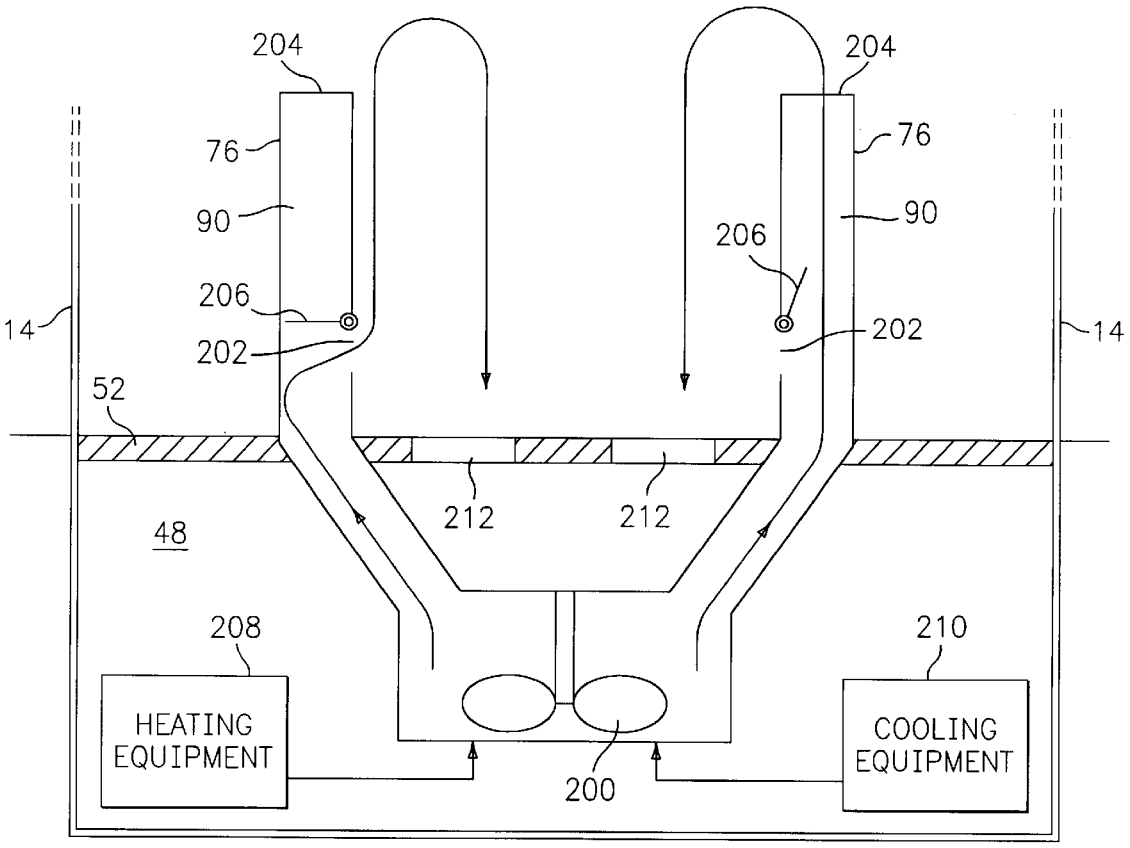
FIG. 12 illustrates a system for heating/cooling the house of the present invention.

Referring now to FIG. 12, an alternative approach to heating/cooling the house may be utilized. In this alternative approach, a single central fan 200 is provided in the crawl space 48 to move cold or hot air from the crawl space 48 via pipes 90. As shown in the figure, each pipe 90 is provided with an opening 202 adjacent a lower end, an opening 204 at its top, and a pivoting damper 206. Corresponding openings are provided in the wall 76 to allow heated/cooled air to enter the space 84. The central fan 200 is connected to heating and cooling equipment. Preferably, the heating equipment 208 is separate from the cooling equipment 210. When cooling air is to be provided, the damper 206 is positioned to direct the air through the top opening 204. When heated air is to be provided the damper 206 is positioned to direct the air through the lower opening 202. If desired, return vents or slots 212 may be provided in the floor.

If desired, the dampers 206 may be eliminated. In such a construction, the central fan 200 comprises a reversible fan. This allows the fan to create a flow in one direction during heating and in the other direction during cooling. During heating, the heated air would flow upwardly through returns 212 and downwardly through the pipes 90. During cooling, the cooled air will flow upwardly through the pipes 90 and downwardly through returns 212.

Figure 13:
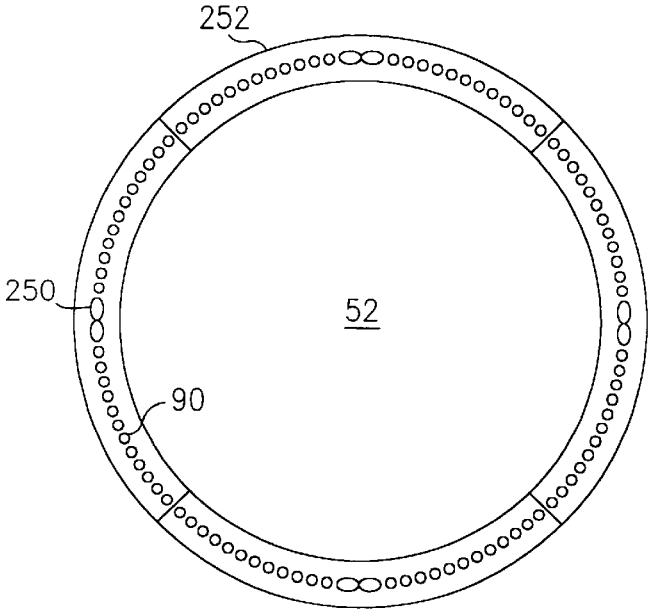
FIG. 13 illustrates an alternative system for heating/cooling the house of the present invention.

In yet another embodiment, a circular duct may be built under the inner wall 76 containing the pipes 90. The circular duct communicates directly with the pipes 90 and with a central fan. If desired, instead of communicating with a central fan, duct 252 could be divided into four sections as shown in FIG. 13. Each section could have a reversible fan 250 in it. The fan 250 in each section communicates with a plurality of pipes 90 having only a top opening and a bottom opening. Operating the fans 250 produces movement of the air upwardly and downwardly depending on the direction of rotation of the fans. The air thus transferred will displace the air present in the receiving area allowing it to flow into or out of the returns in the floor. The fans 250 can function simultaneously but operating them individually allows the control of four zones of the living space. This system does not require inflow of air from the outside, rather it allows recycling of the air present in the target zones, resulting in energy conservation.

If desired, the inner surface of wall 76 may be formed by a plurality of pipes 90 disposed vertically and adjacent to one another. The pipes 90 establish communication between the crawl space 48 and the living area. To accommodate the pipes 90, the floor 52 may be built with slots (not shown) to accommodate the pipes 90. The pipes 90 can be covered by any flexible opaque material or left exposed to provide texture. The pipes 90 could also be used as bases for decoration.

The building structure of the present invention is designed to create different impressions on individuals visiting it. For example, due to the entranceway hall being separate from the main area of activity, an individual coming into the main area of activity may be surprised by the passage from a restricted area of low ceiling to the space of large volume and height.

Yet another advantage to the building structure of the present invention is its ability to accept interior decoration which harmonizes with the sentiment of the inhabitant. For example, sections of the lower wall of the activity area may be covered with sheep skins, the sconces may be made to imitate torches, etc. In other words, the disposition of the functional structures allows great latitude in choosing the aesthetic components of the building structure. The hub and columnar structure arrangement of the present invention, concentrating the support requirements on independent points, allows such freedom.

When the building structure of the present invention is used as a dwelling, the limitation of activities to the internal space 84 encourages the interaction of family members and visiting friends. While the planters 110 and 112 interrupt this common space and offer semi-privacy, they do not stifle communications between individuals. Cooking, eating, playing, studying and working become integrated activities. The customary occupation of the kitchen by close friends invited for dinner is encouraged and, again, cooking and eating may become shared activities.

If one desires, changes can be made to the characteristics of the building structure. For example, the garage 96 could be moved to one side of the building structure 10 to offer an open view of the surroundings from the kitchen. The use of wall panels with virtual panoramas, if created to be realistic enough, may offer the advantage of variety according to the desires and the mood of the occupants such as a view of the mountains or the sea in the summer or of the desert or the orange blossom of Sicily in the winter.

When the building structure 10 is erected in climates that have substantial amounts of snow in the winter, electrical elements may be intertwined with the mesh 66 to form a snow melting system. Alternatively, a flow of warm air may be directed towards the roof canopy 26 to melt the snow. Adjusting the slope of the roof canopy 26 may also be used to alleviate the problem of snow load.

Still another advantage to the house of the present invention is the fact that only the exterior wall is a load bearing wall. This allows the homeowner the ability to utilize the interior space in the most efficient and aesthetically pleasing manner.

It is apparent that there has been provided in accordance with the present invention a circular building structure which fully satisfies the means, objects, and advantages set forth hereinbefore. While the building structure of the present invention has been described in the context of specific embodiments thereof, other variations, alternatives, and modifications will become apparent to those skilled in the art after reading the present disclosure. Therefore, it is intended to embrace all such variations, alternatives, and modifications as fall within the broad scope of the appended claims.

What is claimed is:

1. A circular building structure comprising:

a plurality of columnar structures, each of said columnar structures extending from a point below ground level to a desired height above ground level;

rigid wall structures positioned between said columnar structures and forming a circular exterior wall with said columnar structures, said wall structures and said columnar structures defining an outer wall enclosing an inner space;

a cylindrical central hub positioned above said inner space; and means for supporting a roof, said roof supporting means being joined to one of said columnar structures and to said central hub.

2. A circular building structure comprising:

a plurality of columnar structures, each of said columnar structures extending from a point below ground level to a desired height above ground level;

wall structures positioned between said columnar structures and forming a substantially circular exterior wall with said columnar structures, said wall structures and said columnar structures defining an outer wall enclosing an inner space;

a central hub positioned above said inner space;

means for supporting a roof, said roof supporting means being joined to one of said columnar structures and to said central hub;

said building structure further including a foundation; and said columnar structures being equally spaced about said foundation.

3. A building structure according to claim 2, wherein said foundation includes an excavated ground portion and wherein a first retaining wall is positioned beneath ground level, a circular slab is positioned above an excavated ground portion, and a floor is positioned above said circular slab, whereby said retaining wall, said slab and said floor define a crawl space.

4. A building structure according to claim 3, further comprising a layer of insulation between a lower surface of said slab and said excavated ground portion.

5. A building structure according to claim 3, further comprising a plurality of steel columns embedded in said slab for supporting said floor.

6. A building structure according to claim 3, wherein said floor is positioned below ground level.

7. A building structure according to claim 3, further comprising a second retaining wall positioned above said first retaining wall, said second retaining wall being thinner than said first retaining wall and extending upwards from an upper edge of said first retaining wall.

8. A building structure according to claim 7, wherein said wall structures comprises a plurality of said second retaining wall.

9. A building structure according to claim 3, wherein said floor is substantially at ground level.

10. A building structure according to claim 3, wherein said floor is formed by elements of geometric shape.

11. A building structure according to claim 2, wherein said central hub comprises a cylindrical component formed from steel or plastic.

12. A circular building structure comprising:

a plurality of columnar structures, each of said columnar structures extending from a point below ground level to a desired height above ground level;

wall structures positioned between said columnar structures and forming a substantially circular exterior wall with said columnar structures, said wall structures and said columnar structures defining an outer wall enclosing an inner space;

a central hub positioned above said inner space;

means for supporting a roof, said roof supporting means being joined to one of said columnar structures and to said central hub;

said roof supporting means comprising a plurality of trusses; and each of said trusses being connected to said central hub so that an upper surface of each said truss is below an upper edge of said central hub and a lower surface of each said truss is above a lower edge of said central hub.

13. A building structure according to claim 12, further comprising a mesh joined to an upper surface of each of said trusses to form a continuous roof supporting surface.

14. A building structure according to claim 13, wherein said mesh is formed by a plurality of trapezoidally shaped mesh sections.

15. A building structure according to claim 13, wherein said roof comprises a fabric roof cover positioned over said mesh.

16. A building structure according to claim 15, wherein said roof cover is formed from a water repellant material.

17. A building structure according to claim 16, wherein said water repellant material comprises canvas or a polyester film.

18. A building structure according to claim 15, further comprising a ring structure adjacent an upper end of said roof cover and said ring structure being joined to an exterior surface of said central hub.

19. A building structure according to claim 18, wherein said ring structure is formed from either a metal or a plastic material.

20. A building structure according to claim 13, further comprising roof insulation material positioned between said treusses and below a lower surface of said mesh.

21. A building structure according to claim 20, wherein said roof insulation material comprises pieces of foam rubber or pieces of a foam material.

22. A building structure according to claim 20, wherein said roof insulation material is joined to said mesh.

23. A building structure according to claim 20, wherein said roof insulation material is supported by cords extending between said trusses.

24. A circular building structure comprising:

a plurality of columnar structures, each of said columnar structures extending from a point below ground level to a desired height above ground level;

wall structures positioned between said columnar structures and forming a substantially circular exterior wall with said columnar structures, said wall structures and said columnar structures defining an outer wall enclosing an inner space;

a central hub positioned above said inner space;

means for supporting a roof, said roof supporting means being joined to one of said columnar structures and to said central hub; and a skylight positioned above said central hub.

25. A building structure according to claim 24, wherein said skylight is dish shaped and is supported with respect to said central hub by a support ring attached to a lower surface of said skylight.

26. A building structure according to claim 25, wherein said support ring fits within the internal space of said central hub.

27. A circular building structure comprising:

a plurality of columnar structures, each of said columnar structures extending from a point below ground level to a desired height above ground level;

wall structures positioned between said columnar structures and forming a substantially circular exterior wall with said columnar structures, said wall structures and said columnar structures defining an outer wall enclosing an inner space;

a central hub positioned above said inner space;

means for supporting a roof, said roof supporting means being joined to one of said columnar structures and to said central hub; and an inner wall spaced from said outer wall and dividing said inner space into a perimetric space and an internal space.

28. A building structure according to claim 27, wherein said inner wall is concentric with said outer wall.

29. A building structure according to claim 27, further comprising a plurality of walls for dividing said perimetric space into a plurality of rooms.

30. A building structure according to claim 29, wherein said plurality of walls includes at least one passageway wall positioned intermediate said outer wall and said inner wall to define at least one passageway with said inner wall.

31. A building structure according to claim 30, wherein said plurality of dividing walls includes a plurality of room forming walls extending between said outer wall and said at least one passageway wall.

32. A building structure according to claim 30, wherein said outer wall includes a door to enter and exit said building structure and said plurality of dividing walls including two arcuate walls for forming an entranceway hall to said building structure, whereby said entranceway hall is accessed through said door.

33. A building structure according to claim 27, further comprising a crawl space beneath said internal and perimetric spaces and said inner wall including a plurality of pipes for conveying air from said crawl space.

34. A building structure according to claim 33, further comprising an air transfer device located within each of said pipes.

35. A building structure according to claim 27, wherein said internal space is undivided.

36. A building structure according to claim 35, further comprising a sunken pit area within said internal space.

37. A building structure according to claim 36, wherein said sunken pit area includes a table and seats for individuals.

38. A building structure according to claim 36, further comprising a fireplace at one end of said sunken pit area.

39. A building structure according to claim 38, further comprising a rectangular covering over said fireplace, said rectangular covering housing pipes for carrying smoke from said fireplace.

40. A building structure according to claim 39, wherein said rectangular covering houses appliances to be used by occupants of the building structure.

41. A building structure according to claim 38, wherein said internal space includes a kitchen area, said kitchen area being on an opposite side of said rectangular covering than said sunken pit area.

42. A building structure according to claim 41, wherein said kitchen area includes a range and a hood.

43. A building structure according to claim 36, further comprising at least one spiral staircase for gaining access to said pit area.

44. A building structure according to claim 36, further comprising two planters in said internal space for creating semi-private areas.

45. A building structure according to claim 27, further comprising a ceiling over said internal space.

46. A building structure according to claim 45, wherein said ceiling is formed by a cloth canopy.

47. A building structure according to claim 46, wherein said cloth canopy has a lower edge fixed to said inner wall and an upper edge joined to said central hub.

48. A building structure according to claim 47, wherein said upper edge of said cloth canopy is joined to said central hub by a ring which fits within said central hub.

49. A building structure according to claim 47, wherein portions of said cloth canopy are suspended from said roof supporting means.

50. A building structure according to claim 46, wherein said cloth canopy is formed from a translucent material.

51. A building structure according to claim 27, further comprising a flat ceiling over said perimetric space.

* * * * *